United States Patent [19]

Folks

[11] Patent Number: 4,893,421

[45] Date of Patent: Jan. 16, 1990

[54] HUNTING SHOE NOISE SUPPRESSOR

[76] Inventor: Ronald J. Folks, Box 17, Kaw City, Okla. 74641

[21] Appl. No.: 294,336

[22] Filed: Jan. 9, 1989

[51] Int. Cl.[4] ..... A43B 05/18; A43B 05/00

[52] U.S. Cl. ..... 36/132; 36/116; 36/7.1 R

[58] Field of Search ..... 36/1 R, 132, 136, 1.5, 36/7.1 R, 7.5, 116, 113, 62; 2/DIG. 6

[56] References Cited

U.S. PATENT DOCUMENTS

| | | | |
|---|---|---|---|
| D. 185,289 | 5/1959 | Kadlec | 36/116 |
| 2,128,134 | 8/1938 | Giusto | 36/7.5 |
| 2,515,070 | 7/1950 | Anderson | 36/7.5 |
| 2,784,436 | 3/1957 | Peterson | 36/113 |
| 3,346,971 | 10/1967 | Kiwala | 36/136 |
| 4,073,075 | 2/1978 | O'Brien | 36/136 |
| 4,094,081 | 1/1978 | Reiner et al. | 36/116 |
| 4,665,633 | 5/1987 | Edgerton | 36/7.1 R |
| 4,697,362 | 10/1987 | Wasserman | 36/136 |
| 4,713,895 | 12/1987 | Vallieres | 36/7.1 R |
| 4,784,143 | 11/1988 | Hebert et al. | 36/132 |
| 4,807,372 | 2/1989 | McCall | 36/7.5 |

*Primary Examiner*—Steven N. Meyers
*Attorney, Agent, or Firm*—Robert K. Rhea

[57] ABSTRACT

A noise suppressing attachment for a hunter's shoe or boot includes a flexible depending wall removably secured to the perimeter of the shoe or boo sole by a Velcro fastener. The wall, in combination with the sole and surface of the earth, forms a closed chamber trapping the sound of crushed leaves or twigs when stepped on by the hunter.

3 Claims, 1 Drawing Sheet

HUNTING SHOE NOISE SUPPRESSOR

BACKGROUND OF THE INVENTION

1. Field of the invention

The present invention relates to hunting equipment and more particularly to hunting boots.

When stalking game in the woods during dry weather the hunter, by stepping on dried leaves, small twigs, etc., generates considerable noise which is easily detected by and drives away the game.

This invention provides an attachment for the hunter's boots which at least minimizes and generally eliminates the sound of leaves crushed or twigs broken when stepped on.

2. Description of the prior art

Although having different purposes the most pertinent prior art is believed to be U.S. Pat. No. 4,094,081. This patent discloses a sandal-type sole provided with a depending rigid perimeter wall, wedge-shape in transverse section, which compacts and compresses sand when stepped thereon to provide increased traction for the user particularly on loose dry sand.

This invention is distinctive over this patent by providing a pressure collapsed wall removably attached to the perimeter of the sole of a hunting boot for trapping leaves and/or twigs stepped on and crushed within the confines of the surrounding wall.

SUMMARY OF THE INVENTION

An elongated cord-like strand of resilient material is fabric encased to provide a laterally projecting fabric portion secured to the perimeter of a user's shoe or boot sole by a coextensive Velcro fastener respectively secured to the fabric and perimeter of the shoe sole.

The principal object of the invention is to provide a noise suppressing attachment for a hunter's shoe or boot which forms a cavity adjacent the depending surface of the boot sole which suppresses sound generated by the crushing of leaves or breaking of twigs trapped within the perimeter of the shoe attachment thus permitting the hunter to watch for game and minimize his attention to what is being stepped on.

DESCRIPTION OF THE PREFERRED EMBODIMENTS

Figure 1:
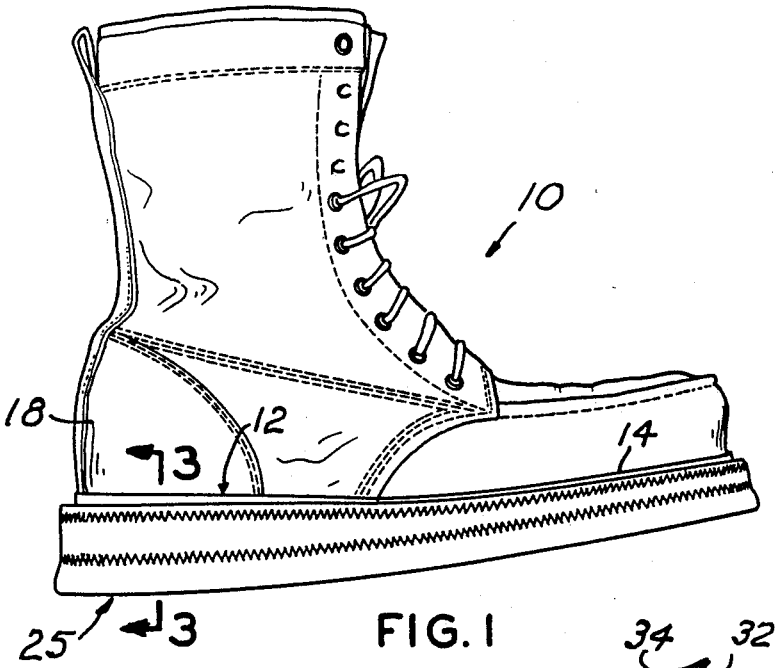
FIG. 1 is a side elevational view of a hunting boot with the device attached thereto.
Figure 2:
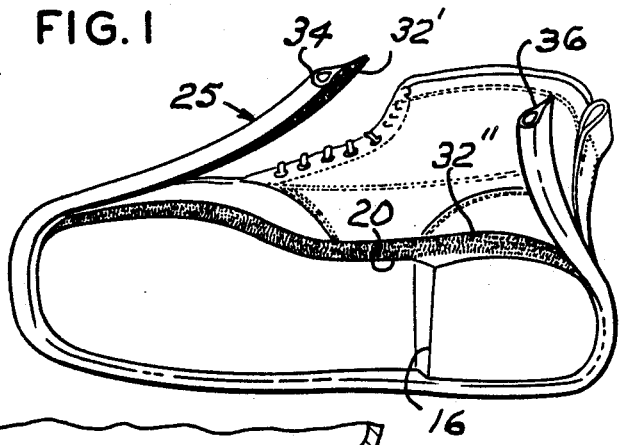
FIG. 2 is a perspective view of the boot sole bottom illustrating the noise suppressor with its end portions pealed away from the sole.

Like characters of reference designate like parts in those figures of the drawings in which they occur.

In the drawings:

The reference numeral 10 indicates one of a pair of boots of the type frequently worn by hunters while hunting. The boot 10 is provided with a sole 12 having a toe portion 14 at its forward end and a heel 16 depending from the boot counter 18 and defining a shank portion 20 between the toe end portion and heel end portion. The sole 12 has a continuous perimeter edge generally normal to the bottom surface of the sole and heel.

The numeral 25 indicates a flexible wall device which is removably connected in depending relation with the perimeter of the boot sole 12. The wall 25 is substantially coextensive with the perimeter of the boot sole 12 and comprises a strand-like length of resilient material 26 which may be synthetic material, such as plastic or foam rubber.

A length of sheet material which may be canvas or other fabric 28, coextensive with the strand 26 and having a selected width, transversely encompasses the strand in loop fashion and is doubled over upon itself as at 30 and secured together to project laterally of the strand 26. The transverse width of the secured together portion 30 of the fabric is at least equal to the thickness of the sole at its toe portion 14.

The wall 25 is secured in depending relation to the perimeter edge of the sole 12 by a Velcro fastener 32 coextensive with the length of the wall forming member 25.

Figure 3:
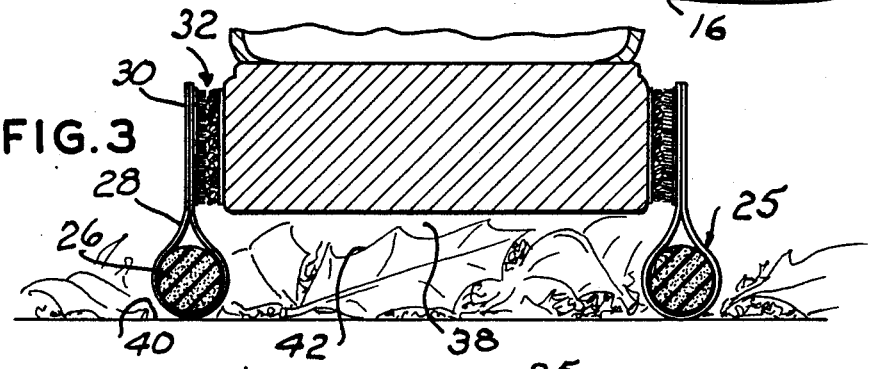
FIG. 3 is a fragmentary vertical cross sectional view, to a larger scale, taken substantially along the line 3—3 of FIG. 1; and, FIG. 4 is a fragmentary elevational view of a the inwardly disposed side surface of the device.
Figure 4:
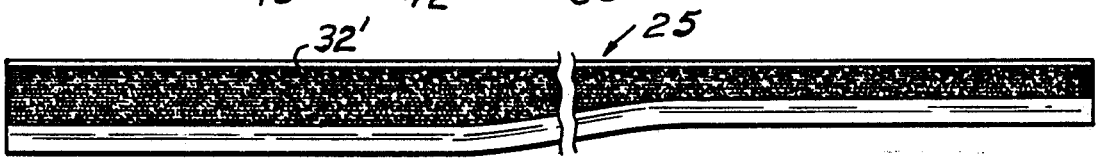

One-half of the Velcro fastener 32 is bonded to the surface of the fabric wall portion 30, as at 32', and the other half or companion member of the Velcro fastener is similarly boned to the perimeter of the sole 12, as at 32''. The wall 25 is attached to the perimeter of the sole by manually positioning the Velcro fastener members in cooperative position with the respective ends 34 and 36 of the wall member being disposed in abutting relation at one side of the boot sole 12. When installed, as illustrated by FIGS. 1 and 3, the wall 25 in combination with the sole 12 defines a cavity 38 having a depth at least equal to the vertical thickness of the boot heel 16, within the wall and between the surface of the sole and surface of the earth 40. The user's weight substantially collapses the wall 25 and crushes leaves 42 and twigs, or the like.

When not used for hunting the wall 25 and Velcro half 32' is simply pealed away from the boot sole 12.

Obviously the invention is susceptible to changes or alterations without defeating its practicability. Therefore, I do not wish to be confined to the preferred embodiment shown in the drawings and described herein.

I claim:

1. In a hunter's shoe or boot having a sole defining a generally flat bottom surface of toe and heel end portions and a substantially vertical perimeter edge surface, the improvement comprising:

continuous imperforate flexible wall means overlapping the perimeter edge surface in coextensive relation and depending therefrom normal to the bottom surface for forming a cavity between said shoe or boot and a supporting surface; and means including cooperative self-adhering members for securing the wall means to the perimeter edge surface.

2. The combination according to claim 1 in which the securing means comprises:

a Velcro fastener interposed between the wall means and the perimeter edge surface.

3. The combination according to claim 2 in which the wall means comprises:

a strand of resilient material having a diameter at least equal to the thickness of the toe end portion of the sole and coextensive with the perimeter edge surface; and, sheet material encompassing and projecting laterally from said strand a distance at least equal to the diameter of the strand.

* * * * *